United States Patent [19]

Woolslayer et al.

[11] 4,094,051

[45] June 13, 1978

[54] METHOD OF MAKING SHEAVES

[75] Inventors: Homer J. Woolslayer; Cecil Jenkins; Robert D. Woods, all of Tulsa, Okla.

[73] Assignee: Lee C. Moore Corporation, Tulsa, Okla.

[21] Appl. No.: 797,333

[22] Filed: May 16, 1977

[51] Int. Cl.[2] ..... B21K 1/42

[52] U.S. Cl. ..... 29/159 R; 29/412; 29/416; 74/230.8; 113/116 D; 228/170

[58] Field of Search ..... 29/159 R, 416, 412; 113/116 D, 116 V, 116 W, 116 BB; 74/230.8, 242.3; 228/170, 155, 164, 160, 162

[56] References Cited

U.S. PATENT DOCUMENTS

| | | | |
|---|---|---|---|
| 2,730,795 | 1/1956 | Bloss | 29/159 R |
| 2,846,893 | 8/1958 | Bagley | 74/230.8 |
| 3,722,309 | 3/1973 | Shaffer | 29/159 R X |
| 3,962,926 | 6/1976 | Kotlar | 74/230.8 |
| 4,000,634 | 1/1977 | Hixson | 29/159 R X |

*Primary Examiner*—Victor A. DiPalma

*Attorney, Agent, or Firm*—Brown, Murray, Flick & Peckham

[57] ABSTRACT

A series of adjoining concentric rings are cut from a metal plate. The same number of hubs, all the same shape, are also cut from plate material as are annular web plates to fit around hubs, but the outer diameters of the web plates are different from one another in order to fit in the different rings. Each web plate is welded to a hub and encircling ring to form a sheave that is then provided with a circumferential groove to provide a grooved rim for receiving a wire line. The sheaves can be mounted side by side on a common shaft, with the largest sheave at one end and the smallest at the opposite end. This arrangement is suitable for a crown block.

3 Claims, 10 Drawing Figures

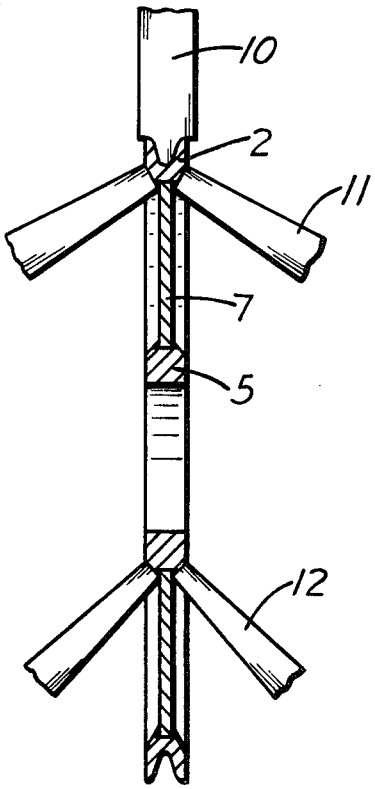

METHOD OF MAKING SHEAVES

In making crown blocks and the like for oil well drilling derricks and masts, the current practice is to use sheaves, all of which are the same size. They are made in various ways. It is an object of this invention to provide a method of making sheaves in which there is the least possible waste of the material from which they are formed. Another object is to construct a crown block from such sheaves, which will increase the useful life of the wire line supported by the crown block.

The preferred embodiment of the invention is illustrated in the accompanying drawings, in which FIG. 1 is a view of a metal plate from which three concentric rings have been cut;

FIG. 2 is a central cross section of the plate and rings;

FIGS. 3 and 4 correspond to FIGS. 1 and 2, respectively, but show a second plate;

Figure 1:
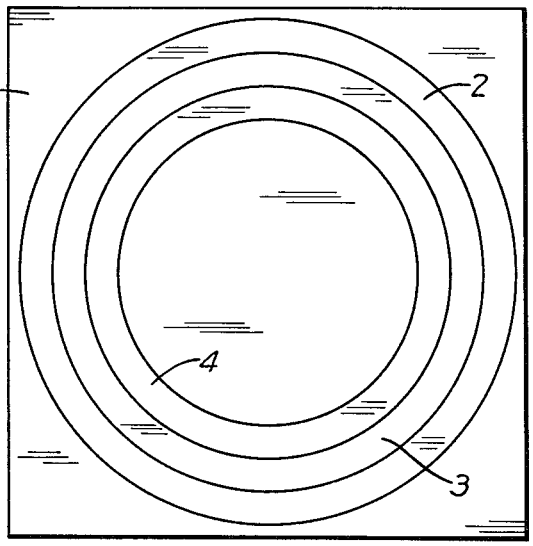
Figure 2:
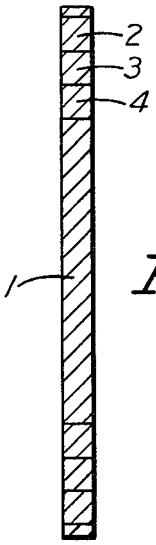

Referring to FIG. 1 of the drawings, a series of sheaves of different diameters are formed by first selecting a metal plate 1 large enough to allow the rim of the sheave of largest diameter to be cut from it. A plurality of adjoining concentric rings then are cut from the plate. Each ring can be cut out separately and removed before the next one is cut out, or all rings can be cut simultaneously and then separated. Usually, three rings 2, 3 and 4 will be formed in this way, but four and perhaps five could be made. The inner diameter of the smallest ring should be somewhat greater than the hub that will form part of the finished sheave. The thickness of the plate should be substantially the same as the axial width of the sheave rims that are to be formed from the rings.

Figure 6:
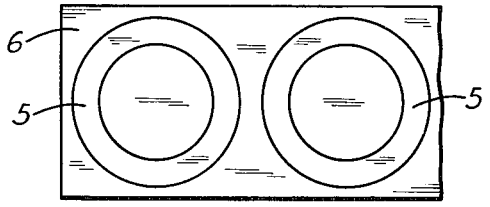
FIG. 6 is a fragmentary view of plate material from which hubs are cut.

Assuming, for example, that three rings are cut from the plate, three metal hubs and three web plates also will be required. The circular hubs 5 generally will have to be cut from different plate material 6, as shown in FIG. 6, especially when it is desired that they shall be made of a different metal. The rings generally would be cut from steel capable of being hardened, while the hubs would be made from steel that is suited better for welding. Also, it often is desirable that the plate material for the hubs have a different thickness than that for the rings.

Figure 5:
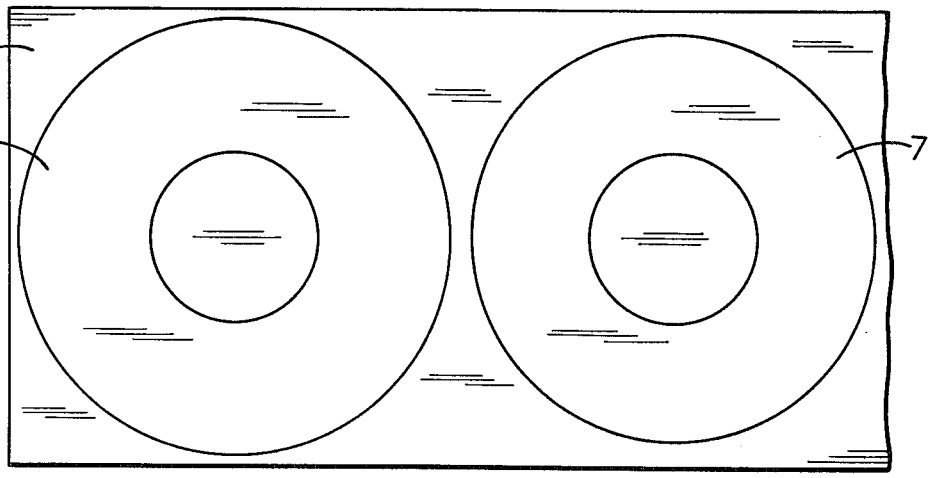
FIG. 5 is a fragmentary view of plate material from which web plates are cut.

The hubs can be cut out as rings or, if cut out as discs, central openings then will be cut in them to receive bearings and a supporting shaft. All of the hubs are the same size. The webs 7 are annular members cut from thinner stock 8. As shown in FIG. 5, the central openings in the webs are all the same size for snugly receiving the hubs, but the outer diameters of the webs are different so that each web will fit inside a different ring.

Figure 7:
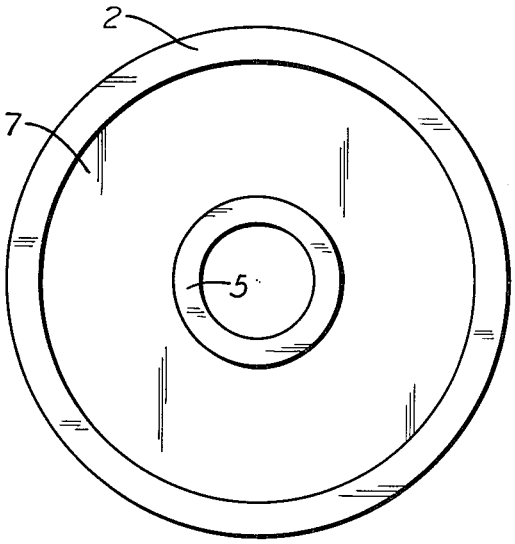
FIG. 7 is a side view of one sheave formed from a ring and web plate and hub.
Figure 8:
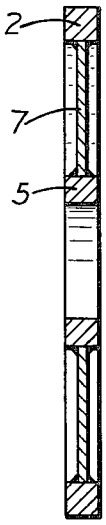
FIG. 8 is a central cross section of the sheave.
Figure 9:
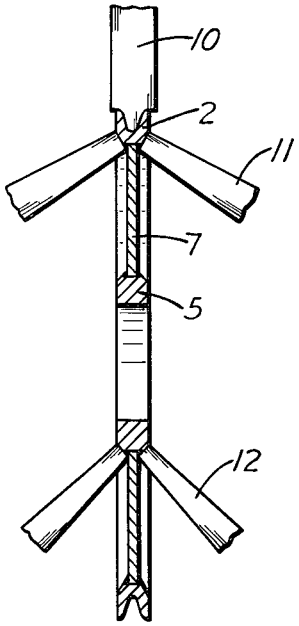
FIG. 9 is a view similar to FIG. 8, but showing the rim and hub of the sheave being machined.

After a ring, web and hub are assembled, all three parts are welded together as shown in FIGS. 7 and 8. Thus, three sheave blanks of three different diameters can be formed. A circumferential groove for receiving a wire line then is formed in the periphery of each ring in any suitable way, such as by grinding or by a cutting tool 10 as shown in FIG. 9. The opposite sides of the ring also can be shaped by suitable tools 11 to the desired contour in the same way to form a finished sheave rim. The outer edges of the hub likewise may be shaped by tools 12.

Figure 3:
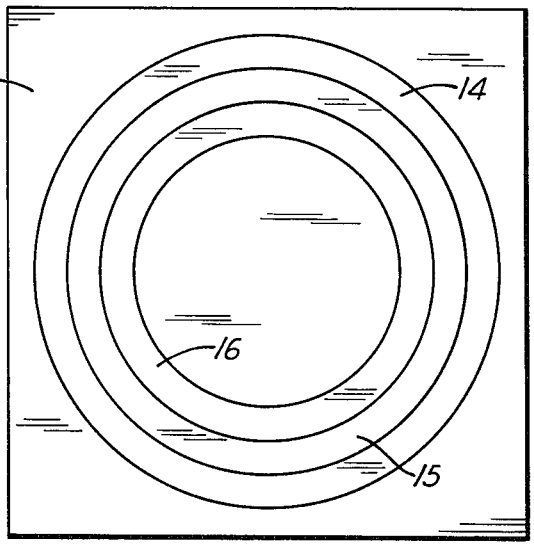
Figure 4:
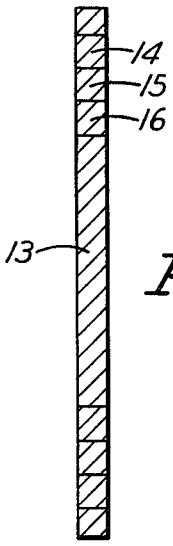
Figure 10:
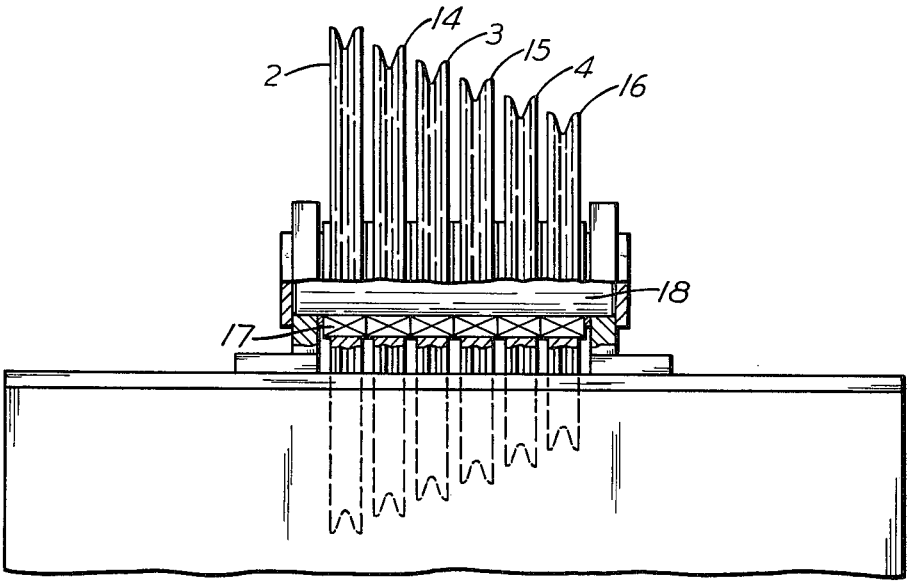
FIG. 10 is a side view, partly in vertical section, of a crown block utilizing the sheaves made by this invention.

In case more than three or four sheaves are to be used side by side in a single series, the smallest ring would be too small to form the rim of a sheave of practicable size if all rings were cut from the same plate. Consequently, another similar plate 13 shown in FIG. 3 is provided with a second series of adjoining concentric rings 14, 15 and 16 are cut from it. In order to keep the smallest ring 16 from being too small and yet to provide a row of sheaves graduated uniformly in size from one end of the row to the other, the diameter of the outermost ring cut from this second plate is substantially the same as the diametrical distance between two points midway between the inner and outer diameters of the outermost ring 2 cut from the first plate. Consequently, the sheaves formed from one plate can be alternated with those formed from the other plate so that the sheaves are stepped down in size by uniform increments from one end of the row to the other as shown in FIG. 10. The increments are smaller than they would be if all sheave rims were cut from a single plate. Bearings 17 are mounted in the sheave hubs and are supported by a shaft 18 extending through them.

It will be seen that in making the sheaves there is very little waste material. In some cases, a hub could be cut from the central disc left after the rings have been cut from a plate.

The method of making sheaves disclosed herein is especially suited, although not limited, to making crown block sheaves for oil well drilling derricks and masts. When a crown block is provided with such a series of sheaves graduated in size, the fast line should travel over the largest sheave in the set. If it is assumed that the smallest sheave is normal size for a crown block, the largest sheave at the opposite end of the row will result in longer wire line life than is the case when all sheaves are normal size. This is because the life of a wire line is limited by the number of times it is bent over a sheave. A larger sheave at the fast line end of a crown block tends to offset the higher speed of that sheave so that the number of times the line is bent over the sheave is reduced.

According to the provisions of the patent statutes, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. A method of making a set of wire line sheaves to be mounted side by side on a common axis, comprising selecting a plate of substantially the same thickness as the maximum width of the desired sheave rims, cutting from the plate a series of adjoining concentric rings all having substantially the same radial thickness, cutting from plate material circular hubs all of the same size for the sheaves, cutting from plate material annular web plates each having a central opening for receiving one of said hubs, the outer diameters of said web plates being different from one another with each adapted to fit in a different one of said rings, assembling each ring with a web plate and hub and welding them together to form a sheave, and forming a circumferential groove in the periphery of each ring to form a grooved rim for receiving a wire line.

2. A method according to claim 1, including cutting from a second plate of substantially the same thickness as said first-mentioned plate a second series of adjoining concentric rings each having the same radial thickness as the first-mentioned rings, the outer diameter of the outermost ring in the second series being substantially the same as the distance between two diametrically opposite points midway between the inner and outer diameters of the outermost ring in said first-mentioned series, cutting from plate material enough of said hubs and web plates to be welded to said second series of rings to form additional sheaves, and forming wire line grooves in the peripheries of said second-series of rings.

3. A method according to claim 2, including mounting all of the sheaves side by side on a supporting shaft, with the rims that were cut from one of said plates alternating with those cut from the other plate progressively from the largest sheave near one end of the shaft to the smallest sheave near the opposite end of the shaft.

* * * * *